US005291844A

United States Patent [19]

McCormick

[11] Patent Number: 5,291,844

[45] Date of Patent: Mar. 8, 1994

[54] CLEW FOR A SAILBOARD BOOM

[75] Inventor: Charles D. McCormick, Corpus Christi, Tex.

[73] Assignee: Gulftech, Inc., Corpus Christi, Tex.

[21] Appl. No.: 775,137

[22] Filed: Oct. 11, 1991

[51] Int. Cl.[5] ..... B63B 35/79

[52] U.S. Cl. ..... 114/98; 114/39.2

[58] Field of Search ..... 114/39.2, 97, 98, 99, 114/102, 218; 403/327, 328, 108

[56] References Cited

U.S. PATENT DOCUMENTS

| | | | |
|---|---|---|---|
| 859,233 | 7/1907 | Lane | 403/327 |
| 3,105,710 | 10/1963 | Borgman | 403/327 |
| 3,866,257 | 2/1975 | Lansdale | 403/327 |
| 4,696,248 | 9/1987 | Nedoluha | 114/30 |
| 4,825,793 | 5/1989 | Attey | 114/98 |
| 5,095,838 | 3/1992 | Smith | 114/98 |

FOREIGN PATENT DOCUMENTS

| | | | |
|---|---|---|---|
| 2912671 | 7/1980 | Fed. Rep. of Germany | 114/39.2 |
| 3326617 | 2/1985 | Fed. Rep. of Germany | 114/97 |
| 3718885 | 2/1989 | Fed. Rep. of Germany | 114/97 |
| 2517624 | 6/1983 | France | 114/39.2 |
| 122796 | 5/1989 | Japan | 114/102 |
| 8801517 | 1/1990 | Netherlands | 114/97 |

OTHER PUBLICATIONS

Murray's Marine Windsurfing 1989–1990 Catalog, pp. 5 (top picture) and 8 (center and bottom pictures).

Murray's Marine Windsurfing 1991 Catalog, p. 2 (center column, top, and right column, top).

Primes of California 1991 Catalog, p. 21 (picture second from bottom).

Windsurfing Magazine, Apr. 1991, p. 82 (bottom).

WindRider Magazine, Dec. 1989, pp. 53 (entire) and 103 (top right).

*Primary Examiner*—Michael S. Huppert

*Assistant Examiner*—Thomas J. Brahan

*Attorney, Agent, or Firm*—Guy V. Manning

[57] ABSTRACT

A clew constructed from carbon fiber composite is provided for a sailboard boom, the clew having a pair of cylinders having longitudinal axes and connected together by a trapezoidal central flange having substantially equal non-parallel sides connected to the cylinders parallel to their axes to secure them in a predetermined relative angle. The crew further includes holes through the central flange and notches in the rear edge of the flange for attachment of a lanyard or tie line rope that loops through the holes, around sheaves on the sail and through the notches which secure the end of the lanyard while permitting it to quickly be released for adjustment of sail trim. The clew further comprises a spring pin slot transverse each cylinder that interfaces with a an aft spring pin in a telescoping adjustment tube, the slot facilitating adjustment of the tube within the arm of the boom because the slot allows rotation of the tube without removal from the clew.

10 Claims, 3 Drawing Sheets

Fig. 4
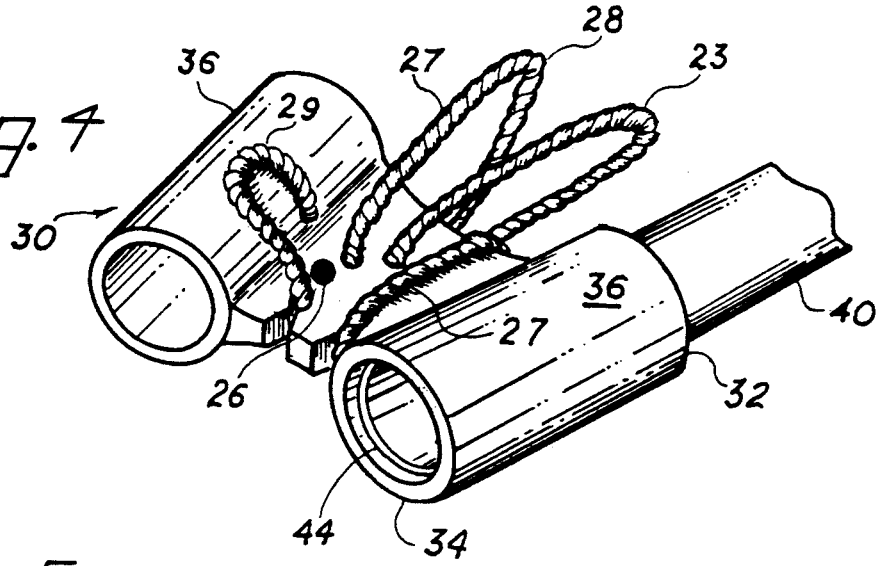
Fig. 5
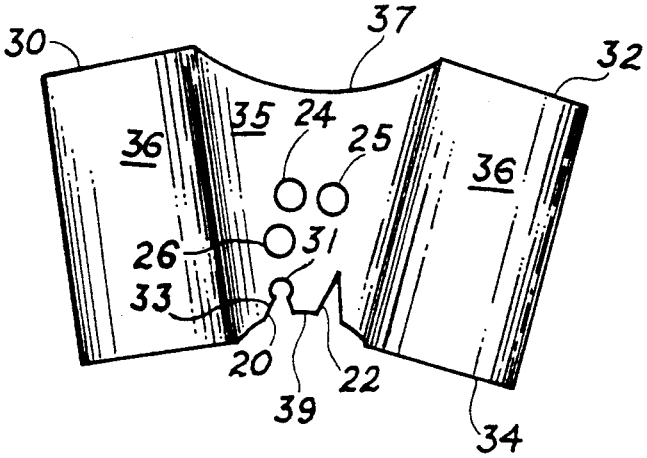
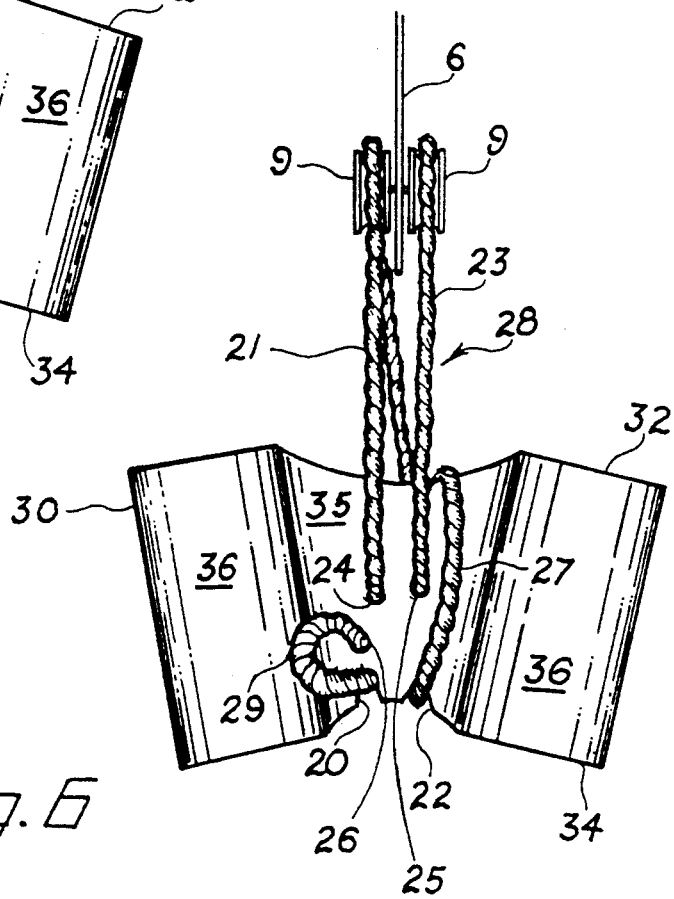
Fig. 6

CLEW FOR A SAILBOARD BOOM

BACKGROUND OF THE INVENTION

1. Field of the Invention

This invention relates to improvements to sailboard booms and particularly to improvements to clews that unit boom arms while providing an attachment point for the trailing edge of a sail.

2. Description of Related Art

Sailboard booms typically comprise a generally ovate structure having a mast end and a clew end interconnected by a pair of boom arms. The mast end attaches to the mast of the sailboard using a fitting tied to or made an integral part of the boom. The arms tie together at the clew end opposite the mast using a clew that serves as an attachment point for the trailing edge of the sail.

Clews are manufactured in a variety of configurations having in common a substantially U-shaped body comprising two studs adapted to connect to the clew ends of the boom arms, and a central portion carrying an attachment means for attaching the sail to the clew. Clews have been made of wood, tubular or solid metal, rubber, plastic and fiberglass. Clew geometry and material makeup has been the subject of experimentation to investigate strength and weight characteristics in keeping with the interest in lighter weight components for sailboard booms. Of recent interest has been the use of carbon fiber composite because of its long run fatigue resistance and superior tensile strength.

During operation, booms and boom components such as clews undergo rapid moment force cycling induced by wind dynamics transferred to the boom from the sail, by wave chop transferred through the mast and through the sailor's body, and by the pumping action used by sailors, particularly in top professional racing, to recover speed after a turn and to precisely trim the sail for maximum speed. Carbon fiber composite provides the long run best performing material, making it desirable material for the construction of clews. But it presents some unique construction problems.

Carbon fiber composite provides high tensile strength, but a clew molded from carbon composite can have no sharp corners or edges between its constituent parts. If carbon fibers must pass around a sharp corner or tolerate a crease transverse to their grain, the composite will not transfer load across the discontinuity created, thus providing almost no strength in that direction. Further, carbon composite cannot easily be welded or assembled from separate pieces. Providing isotropic strength characteristics in an object requires that layers of the carbon fiber be oriented in many directions to provide some moment strength about important axes of the object.

A carbon fiber composite clew having the conventional U-shape would experience moment and shear forces in three dimensions due to the fulcrum role it performs while holding one end of the boom arm which itself experiences significant moment forces. Because of the nearly 180 degree bend of the central portion of a typical U-shaped clew, it is impractical to construct it from carbon composite. The fibers must be carefully aligned to avoid bunching inside the curve and degrading directional strength reliability. For most industrial applications, this is impractical. A clew may be overbuilt to overcome these problems, but only at the cost of additional weight. Typically, enough weight must be added to the U-shaped clew to more than overcome the advantages of using the high strength, light weight carbon fiber composite. A need therefore exists for improvements to clew geometry so that it may be dependably constructed from lighter weight carbon composite material.

When manufactured, booms having varying degrees of flexibilty. Since stiffer brooms provide greater control, particularly with top professional racing, this flexing is undesirable. Flex in a clew adds to boom flex, especially due to the U-shape. A need exists for a clew that has minimum flex as a means to promote stiffness in the boom and provide greater board control to the sailor.

Clews often have adjustable tubes cooperating with or made a part of their arm studs to provide a plurality of initial tensioning positions relative to the trailing edge of the sail. In this fashion, a boom may be used with sails having various widths. A sail trim adjustment is usually included as part of the sail attachment means to fine tune the sail tension once an initial tensioning position has been selected. This usually amounts to a rope or lanyard tying the sail to the clew, but various pully and sheave devices have been devised to permit quick adjustments even during sailing. Because carbon composite has poor shear strength, however, clews made of the composite cannot readily include such conveniences. A need therefore exits for a quick sail trim adjustment means for clews made of carbon composite.

SUMMARY OF THE INVENTION

Accordingly, it is an object of this invention to provide a means of adapting clew geometry to facilitate construction of clews from carbon fiber compounds.

It is another object of this invention to retard the progress of cycling fatigue in sailboard boom components.

It is yet another object of this invention to provide a clew that promotes maximum stiffness of a boom.

It is yet another object of this invention to provide a quick release sail trim adjustment means.

The foregoing objects are achieved by providing a clew for a sailboard boom, the clew having a pair of cylinders having longitudinal axes and connected together by a trapezoidal central flange having substantially equal non-parallel sides connected to the cylinders parallel to their axes to secure them in a predetermined relative angle. The clew further includes holes through the central flange and notches in the rear edge of the flange for attachment of a lanyard or tie line rope that loops through the holes, around sheaves on the sail and through the notches which secure the end of the lanyard while permitting it to quickly be released for adjustment of sail trim.

BRIEF DESCRIPTION OF THE DRAWINGS

The novel features believed characteristics of the present invention are set forth in the appended claims. The invention itself, however, as well as a preferred mode for use, further objects and advantages thereof, will best be understood by reference to the following detailed description of an illustrative embodiment when read in conjunction with the accompanying drawings, wherein:

FIG. 4 illustrates the clew with sail tie line installed;

FIG. 5 details in plan view the clew of the present invention;

FIG. 6 demonstrates tie line interconnection with a sail;

DETAILED DESCRIPTION OF A PREFERRED EMBODIMENT

Figure 1:
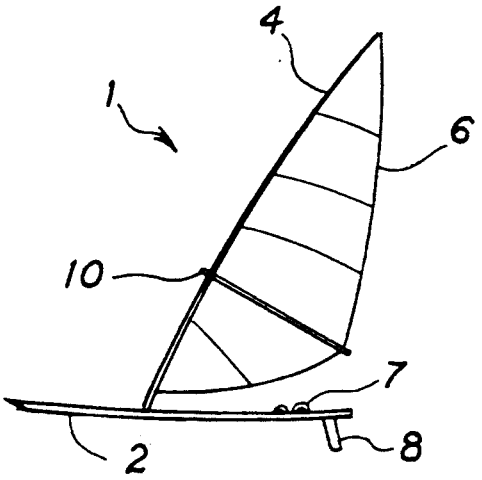
FIG. 1 depicts a typical sailboard rig with mast, sail and boom.
Figure 2:
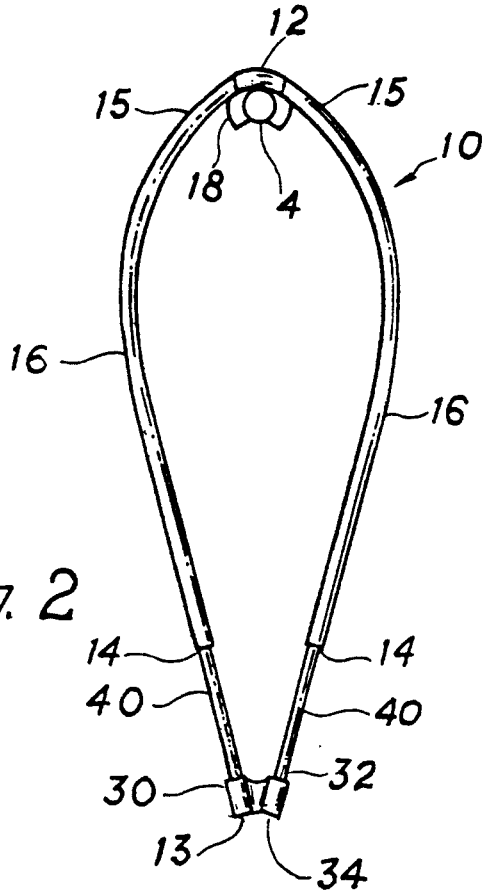
FIG. 2 shows a plan view of a sailboard boom.
Figure 3:
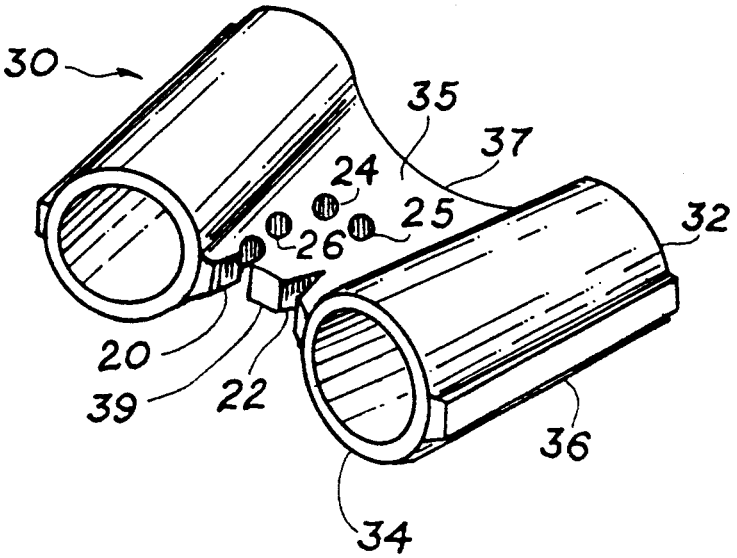
FIG. 3 shows the clew of the present invention in perspective.
Figure 7:
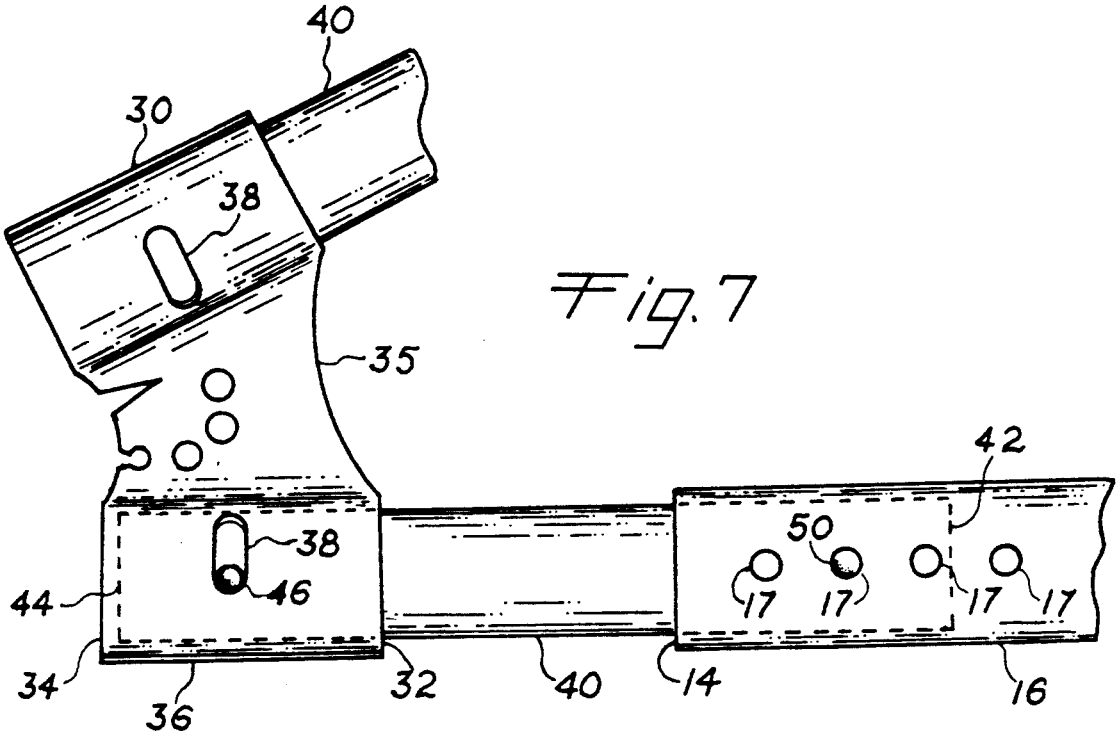
FIG. 7 shows an adjustment tube interfacing the clew and the boom arm.

With reference now to the figures, and in particular to FIGS. 1 and 2, a typical sailboard 2 rigged with mast 4, sail 6 and boom 10 appears. Foot straps 7, where a sailboard sailor stands, and a skeg 8 also appear. The broom 10 has a mast end 12, a clew end 13 and a pair of opposing tubular arms 16 terminating in adjustment tubes 40 at the aft end 14 of the arms 16. A clew 30 holds the adjustment tubes 40 into fixed proximity to each other and provides a point for attaching the sail 6 to the boom 10.

As depicted in FIGS. 3 through 6, the clew 30 made the subject of this invention comprises a pair of hollow cylinders 36 interconnected by a generally trapezoidal central flange 35 such that the centerlines of the cylinders are fixed at a predetermined angle relative to each other. The back end 44 of an adjustment tube 40 telescopes into the front end 32 of the cylinder 36, and a plurality of holes appear in the flange 35.

FIGS. 4 and 6 illustrate the use of these holes for attachment of the sail 6 to the clew 30. A tie line rope or lanyard 28 is knotted at one end (not shown) and threaded through the first hole 24 until the knot abuts the flange 35, preventing the lanyard 28 from being withdrawn from the hole 24. The lanyard then loops around a sheave 9 attached to the sail 6 and back through the second hole 25, thereby forming a first loop 21. The lanyard 28 then again loops around the sheave 9 and back to the clew 30 to pass through a drag notch 22 in the rear edge 39 of the flange 35 to form a second loop 23. The lanyard 28 then wraps round the front edge 37 of the flange 35 and through a jam notch 20. A keeper hole 26 is provided for securing the other end of the lanyard 28, thereby keeping the end secured but easily freed for readjustment of the sail.

Significant to the inventive concept is the jam notch 20. It comprises a substantially cylindrical hole penetrating the flange 35 to form a recess 31. An access notch 33 resembling the drag notch 22 also penetrates the flange 35 between the recess 31 and the rear edge 39 of the flange 35 and intercept the recess 31 such that the recess 31 truncate the notch 33, creating an opening into the recess 31 from the rear edge 39. This opening through the notch 33 permits the lanyard 28 to be drawn into the recess 31 from the side instead of requiring that it be threaded through the recess 31 as, e.g., with the first hole 24.

FIG. 5 depicts the relative sizes of the recess 31 and the first hole 24, indicating that the latter is significantly larger than the former. The first hole 24, the second hole 25 and the keeper hole 26 have substantially equivalent diameters larger than the diameter of the lanyard 28, permitting easy slippage of the lanyard 28 through these holes. The recess 31, however, is smaller than the lanyard 28, causing the lanyard 28 to be constricted when drawn into the recess 31, thus creating friction that retards slippage of the lanyard 28. In concert with the drag notch 22 and the keeper hole 26, the recess 31 captures the lanyard 28 and prevents slippage, thus securing the sail 6 at a given trim. Yet, after removal from the keeper hole 26, the lanyard 28 can be quickly and easily withdrawn from the recess 31 through the access notch 33. As a consequence, this sail 6 attachment system permits quick adjustment of the sail 6 trim, even while the sailor is engaged in high wind sailing.

As detailed in FIGS. 7 through 10, each arm 16 telescopically receives the forward end 42 of an adjustment tube 40 and is retained in place by a forward spring pin 50 that protrudes through a forward spring pin hole 54 in the adjustment tube 40 and cooperates with one of a plurality of latch holes 17 in the arm 16. The rear end 44 of the adjustment tube 40 further telescopes through the front end 32 of a clew cylinder 36 and is retained in a fixed position therein by an aft spring pin 46 that protrudes through an aft spring pin hole 47 in the adjustment tube 40 and into a slot 38 in the clew cylinder 36. Depression of the spring pin 46 against the aft spring 48 permits removal of the clew 30 when required. Likewise, depression of the forward spring pin 50 permits telescopic adjustment of the adjustment tube 40 within the arm 16, relocation to another latch hole 17, or removal altogether from the arm 16.

Such spring pin arrangements are old in the art. Clews commonly include studs protruding forward to telescope into the arm 16 to be secured therein by a spring pin within the stud that mates with one of the latch holes 17. Relocation to another latch hole 17 not juxtaposed to the first one requires depression of the spring pin at least a second time, however, because the spring pin will pop out into the next latch hole 17 it encounters, whether or not it is the target latch hole 17. Thus, adjustment must be done in steps until the target latch hole 17 has been mated with the forward spring pin 50.

Figure 8:
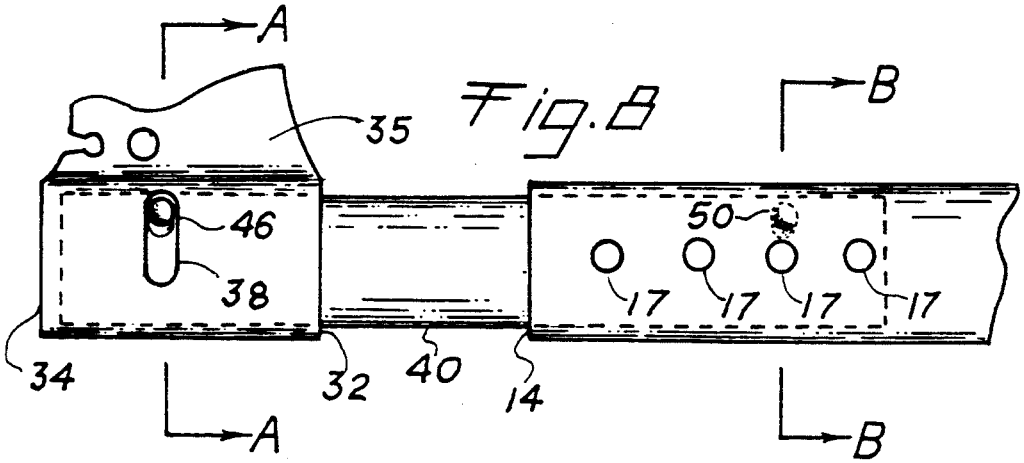
FIG. 8 shows the adjustment tube rotated within the clew and arm.
Figure 9:
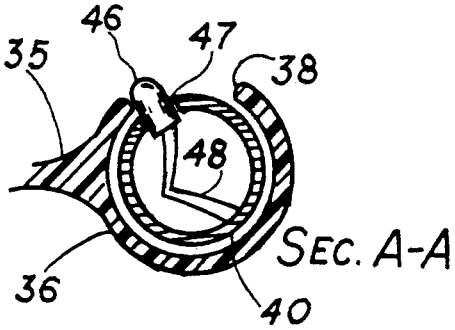
FIG. 9 shows section A—A of FIG. 8, detailing the aft spring pin in the clew.
Figure 10:
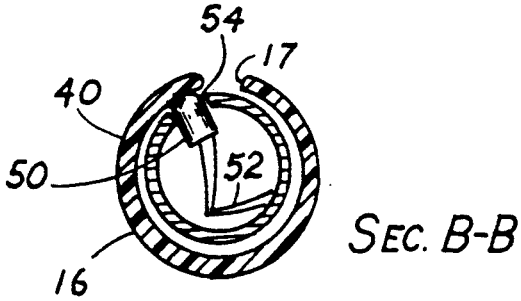
FIG. 10 shows section B—B of FIG. 8, detailing the forward spring pin in the boom arm.

The present invention solves this stepwise adjustment by permitting rotation of the adjustment tube 40 within the arm 16 and the clew 30. The slot 38 on one side of the clew cylinder 36 is preferably at least twice the diameter of the aft spring pin 46. When the forward spring pin 50 is depressed, the adjustment tube can then be rotated as seen in FIGS. 8 and 10 when contrasted to FIG. 7. The adjustment tube can be relocated proximate the target latch hole 17 directly and the rotation reversed to mate the forward spring pin 50 with the target latch 17 without the stepwise process described, thus speeding and facilitating the adjustment. The aft spring pin 46 remains extended, as shown in FIG. 9, thus retaining the adjustment tube 40 within the clew 30, a convenience not available absent the slot 38 and an adjustment tube 40 separate from the clew 30.

The carbon composite material used in fabrication of the clew comprises one of a group of composites known in the relevant art as fiber-reinforced thermoset resins. Preferably, the carbon composite comprises a high modulus, unidirectional, continuous filament, epoxy pre-impregnated, high-weight, graphite composite exemplified by Fortafil #902C2 marketed by Fortafil Fibers, Inc., of Rockwood, Tenn. The clew is preferably constructed in a static mold using standard layup techniques and heat cured at temperatures in the range of 250–350 degrees Fahrenheit. The finished clew will preferably comprise a 70% carbon fiber to 30% resin vehicle ratio by weight.

While the invention has been particularly shown and described with reference to a preferred embodiment, it will be understood by those skilled in the art that various changes in form and detail may be made therein without departing from the spirit and scope of the invention. For example, one having ordinary skill in the relevant art will recognize that the sheave 9 system depicted may be replaced with a simple grommet (not shown) or other interface means. In such case, the first loop 21 and second loop 23 would thread through the grommet, likely being twisted approximately 90 degrees to the plane of the sail 6 to do so. Also, since the forces once requiring strong sail attachments to successfully trim the sail 6 are no longer common due to sail 6 and batten improvements, a single loop may be substituted for the first loop 21 and the second loop 23. In such case, the second hold 25 would also be unused or used in lieu of the first hole 24. Additionally, the sequence or arrangement of the loops and wraps can be varied without departing from the spirit of the invention. Further, the keeper hole 26 may be bypassed in favor of tying the lanyard around the flange 35 or an adjustment tube 40 if sufficient lanyard 28 remains to do so. An advantage, however, of the keeper hole 26 lies in the fact that a shorter lanyard 28 may be employed than would be needed absent the keeper hole 26, thus contributing to weight reduction. Finally, variations of the carbon composite may include, but are not limited to, use of standard modulus composites, multidirectional fibers, other resin to fiber weight ratios, and/or differing cure temperature and procedures.

I claim:

1. A clew for a sailboard boom, the boom having a mast end, a clew end, first and second tubular arms interconnecting the mast end and the clew end and defining a first plane perpendicular to a second plane bisecting the boom and defined by a sail attached to the mast and the clew end of the boom, each arm having a fore end at the mast end, an aft end opposite the fore end, and terminating at the clew end with a terminal fitting, the clew comprising two cylinders, each having a front end and a rear end, a longitudinal axis, and concentric interior and exterior walls surrounding and parallel to the cylinder axis and defining a cylinder recess, each cylinder adapted to receive within its recess the terminal fitting of an arm;

a generally trapezoidal flange having a front edge and a rear edge corresponding to the front and rear ends of the cylinders, and having substantially equal non-parallel sides each connected to the exterior wall of a cylinder parallel to the cylinder axis for defining a predetermined angle between the axes of the cylinders.

arm latching means comprising a slot penetrating the cylinder walls, the slot having a length, a width and a slot axis parallel to the slot length and oriented substantially transverse the cylinder axis, the slot being adapted to cooperate with a spring pin having a diameter aligned with the slot axis and protruding from the terminal fitting of the arm; and sail attachment means comprising a plurality of cylindrical lanyard holes penetrating the central flange;

a lanyard adapted to loop around two sail sheaves having a common axis and sandwiching the sail, the lanyard further wrapping around the central flange twice; and a drag notch penetrating the central flange at its rear edge and adapted to receive a loop of the lanyard as it warps around the central flange; and a jam notch penetrating the central flange at its rear edge and adapted to receive and hold the lanyard at the end of its last loop around the central flange.

2. The clew according to claim 1 wherein the slot comprises a length at least twice the diameter of the spring pin for permitting the terminal fitting to rotate within the cylinder without depressing the spring pin.

3. The clew according to claim 2 wherein the terminal fitting comprises a removable adjustment tube telescopically cooperating with the aft end of the boom arm and having generally tubular walls surrounding a fitting axis, a forward end and a back end, and forward and back spring pins protruding through ports in the tubular walls located proximate the forward and back ends, the forward spring pins adapted to cooperate with a plurality of spring pin holes penetrating the walls of the aft end of the arm, and the back spring pin adapted to cooperate with a slot in the clew, for securing the adjustment tube within the arm and the clew.

4. The clew of claim 1 wherein the jam notch comprises a cylindrical hole penetrating the central flange and defining a jam recess adapted to receive and constrict the lanyard for restraining movement thereof; and a substantially V-shaped notch truncated by the perimeter of the jam recess and communicating between the jam recess and the rear edge of the central flange for permitting the lanyard to enter the jam recess from the side.

5. The clew of claim 1 wherein the clew is constructed as a single unit molded from a carbon fiber composite material.

6. A method for quickly adjusting the sailboard sail tension comprising providing a sailboard boom having a mast fitting at one end, a clew end opposite the mast fitting, first and second tubular arms interconnecting the mast fitting and the clew end and defining a first plane perpendicular to a second plane bisecting the boom and defined by a sail attached to the mast, each arm having a mast end and an aft end and terminating at the aft end with a adjustment tube adapted to telescope inside the arm and secured in the arm by a forward spring pin protruding from the adjustment tube to cooperate with a plurality of holes arranged in a row parallel to a longitudinal axis of the arm, the adjustment tube further being secured in a clew by a rear spring pin having a diameter and protruding from the adjustment tube to cooperate with a slot in the clew having a length of at least twice the diameter of the spring pin fitting;

providing a clew having a pair of cylinders connected by a central flange arranged parallel to the first plane and adapted to hold the cylinders at a predetermined angle such that a centerline of the cylinder lies within the first plane, the cylinders having a slot penetrating and oriented perpendicular to the centerline of the cylinder and adapted to cooperate with the rear spring pin of the adjustment tube, the crew further having a sail attachment means on the clew comprising a plurality of cylindrical lanyard holes penetrating the central flange;

a lanyard adapted to loop around two sail sheaves having a common axis and sandwiching the sail, the lanyard further wrapping around the central flange twice; and a substantially V-shaped drag notch penetrating the central flange at its rear edge and adapted to receive a loop of the lanyard as it wraps around the central flange; and a jam notch penetrating the central flange at its rear edge and adapted to receive and hold the lanyard at the end of its last loop around the central flange; then attaching the boom to the mast using the mast fitting;

attaching the boom to the sail using the sail attachment means; then depressing the forward spring pin and rotating the adjustment tube within the arm and the clew; then sliding the adjustment tube inside the arm to align the forward spring pin with a hole; then rotating the adjustment tube to cause the forward spring pin to enter a hole; then grasping the lanyard tail protruding from the jam notch; the yanking the lanyard out of the jam notch; then adjusting the tension in the lanyard by pulling on the lanyard until any slack occurring in the loops around the sail sheaves has been eliminated; then yanking the lanyard into the jam notch for securing the tension in the sail.

7. A clew for a sailboard boom, the boom having a mast end, a clew end, first and second tubular arms interconnecting the mast end and the clew end and defining a first plane perpendicular to a second plane bisecting the boom and defined by a sail attached to the mast and the clew end of the boom, each arm having a fore end at the mast end, an aft end opposite the fore end, and terminating at the clew end with a terminal fitting, the clew comprising two cylinders, each having a front end and a rear end, a longitudinal cylinder axis, and concentric interior and exterior walls surrounding and parallel to the cylinder axis and defining a tubular recess, each cylinder adapted to receive within its tubular recess the terminal fitting of an arm;

a central flange defining a clew plane substantially parallel to the first plane and connecting the cylinders, the flange having a front edge and a rear edge corresponding to the front and rear ends of the cylinders;

latching means for securing each terminal fitting within one of the tubular recesses;

means for attaching the sail to the clew comprising a lanyard adapted to loop around at least one interface means mounted on the sail, and to wrap at least once around the central flange;

a drag notch penetrating the central flange at its rear edge and adapted to receive a loop of the lanyard as it warps around the central flange; and a jam not penetrating the central flange at its rear edge and adapted to receive and hole the lanyard at the end of its last loop around the central flange.

8. The clew of claim 7 wherein the jam not comprises a cylindrical hole penetrating the central flange and defining a jam recess adapted to receive and constrict the lanyard for restraining movement thereof; and a substantially V-shaped notch truncated by the perimeter of the jam recess and communicating between the jam recess and the rear edge of the central flange for permitting the lanyard to enter the jam recess from the side.

9. The clew of claim 7 wherein the attaching means further comprises a keeper hole penetrating the flange for securing a free end of the lanyard.

10. The clew of claim 7 wherein the clew is constructed as a single unit molded from a carbon fiber composite material.

* * * * *